US006007064A

United States Patent [19]

Cote et al.

[11] Patent Number: 6,007,064

[45] Date of Patent: Dec. 28, 1999

[54] SINGULARIZER WITH MAGNETICALLY DIVERTED GRIPPER CONVEYOR AND METHOD OF SINGULARIZING

[75] Inventors: Kevin Lauren Cote, Durham; Richard Daniel Curley, Dover, both of N.H.

[73] Assignees: Heidelberg Web Press, Inc., Dover, N.H.; Heidelberger Druckmaschinen AG, Heidelberg, Germany

[21] Appl. No.: 08/946,691

[22] Filed: Oct. 8, 1997

[51] Int. Cl.[6] ..... B65G 29/00; B65H 29/00; B65H 29/04; B65H 7/12

[52] U.S. Cl. ..... 271/279; 271/204; 271/292; 271/262; 271/265.04; 198/465.4

[58] Field of Search ..... 271/10.4, 82, 84, 271/85, 202, 204 C, 279 D, 292 C, 176, 259, 262 C, 263, 265.01, 265.04 C, 298, 204, 279, 292, 262, 265.04; 198/465.4 C, 687.1, 867.05, 465.04; 209/552, 903

[56] References Cited

U.S. PATENT DOCUMENTS

| | | | |
|---|---|---|---|
| 3,807,314 | 4/1974 | Slemmons | 198/41 X |
| 4,201,286 | 5/1980 | Meier | 271/202 X |
| 5,072,822 | 12/1991 | Smith | 198/465.4 X |
| 5,465,952 | 11/1995 | Eberle et al. | 271/204 |

FOREIGN PATENT DOCUMENTS

| | | |
|---|---|---|
| 0 827 929 | 3/1998 | European Pat. Off. . |
| 1 153 383 | 8/1963 | Germany . |
| WO 98/03420 | 1/1998 | WIPO . |
| WO 98/25845 | 6/1998 | WIPO . |

*Primary Examiner*—William E. Terrell
*Assistant Examiner*—Kenneth W Bower
*Attorney, Agent, or Firm*—Kenyon & Kenyon

[57] ABSTRACT

A collation method and apparatus that is immune from singularization faults which disrupt the collation process. Each signature is loaded into individual grippers of a power and free gripper conveyor system. Those grippers that experience a miss or a double are diverted out of the process stream. Only those grippers that carry one and only one signature are allowed to continue on in the primary signature queue. The grippers that continue on in the primary signature queue are re-queued into a sequential order which eliminates gaps in the queue. The collation machine accepts signatures from the downstream end of the signature queue as the singularization process continues to add signatures to the upstream end of the signature queue. The singularizer uses a track and diverter structure, where grippers without a signature are diverted to the diverter structure and grippers with a signature continue on the track to a collator.

54 Claims, 14 Drawing Sheets

1
2
3
4
6
9
28
54
56
100
101
300

28'
28'
28'
28'
28
54'
39
41
54
59
58
37
60
107
57
106

SINGULARIZER WITH MAGNETICALLY DIVERTED GRIPPER CONVEYOR AND METHOD OF SINGULARIZING

BACKGROUND OF THE INVENTION

1. Field of the Invention

The present invention relates to an apparatus and method for singularizing articles. In particular, the present invention relates to a apparatus and method for singularizing signatures which reduces or eliminates missing, doubling, or feed jams of signatures in the collation process.

2. Description of the Prior Art

Prior art apparatuses for collating signatures, such as sheets, are known. In such apparatuses, signatures are generally loaded into hoppers that are mounted on the collation machine. The collation machine removes signatures one at a time from each desired hopper, and thereafter collates the removed sheets into a bundle. However, the prior art collation machines can result in faults in the collation process, resulting in incorrect, incomplete, and unusable bundles. For example, faults can occur when the collation machine causes a miss, a double, or a feed jam at a particular hopper. A miss occurs when the collation machine fails to remove a sheet from a particular hopper. A double occurs when the collation machine removes more than one sheet from a particular hopper for a particular bundle. A feed jam occurs when the sheet or sheets removed from a hopper become jammed in the collation machine. In each case, these faults negatively impact the production efficiency of the collation machine.

Misses and doubles result in unusable and erroneous bundles being ejected from the collation machine, or require that the machine be stopped to replace the missed sheet or to remove the doubled sheet. As an alternative, the collation machine can inhibit the hoppers that are downstream of the miss or double, resulting in a partially collated bundle being ejected and leaving an empty space in the production cycle.

Jams halt the collation process and require stopping the machine and intervention in order to clear the jam and restart the machine to allow the machine to continue operation. All of these solutions decrease the efficiency of the collating process, and can result in significant waste of material. As the number of hoppers in a collating machine increase, the risk of faults occurring increases exponentially, thereby reducing the effectiveness of the machine.

SUMMARY OF THE INVENTION

The object of the present invention is to develop a collation method and apparatus that is immune from singularization faults which disrupt the collation process. This fault immunity is achieved by loading each signature into individual grippers of a gripper conveyor system. During the singularization process, those grippers that experience a miss or a double are diverted out of the process stream. Only those grippers that carry one and only one signature are allowed to continue on in the primary signature queue. The grippers that continue on in the primary signature queue, after diversion of the grippers with misses or doubles, are re-queued into a sequential order which eliminates gaps in the queue. This re-queuing is accomplished by free-moving abilities of the grippers, which may freely move to positions adjacent those grippers before and after each gripper. The collation machine accepts signatures from the downstream end of the signature queue as the singularization process continues to add signatures to the upstream end of the signature queue.

If there is a singularization or feed jam, two possible responses are available with the apparatus and method of the present invention. First, the apparatus may continue to accept signatures from the queue as the feed jam is cleared. Once the jam is cleared, the singularization process replenishes the queue. In the present invention, the power and free gripper conveyor system allows signatures to be entered into the queue at a rate faster than the rate at which the collation machine removes signatures from the queue. This feature enables a buffer of grippers in the signature queue, which buffer replenishes the queue while the jams are being cleared or after the jams are cleared. As a result, the jam may be cleared during the process of feeding signatures to a collator from the queue, without the need to stop the collation process to clear the jam. A second technique for dealing with jams is to provide multiple singularization stations to feed the same singularization queue. This technique allows a redundant singularization station to be activated and to feed the signature queue if the primary station jams and must be stopped to allow clearing.

BRIEF DESCRIPTION OF THE DRAWINGS

The foregoing and other features of the present invention will become apparent to those skilled in the art to which the present invention relates from reading the following description with reference to the accompanying drawings, in which.

DETAILED DESCRIPTION OF THE INVENTION

Figure 1:
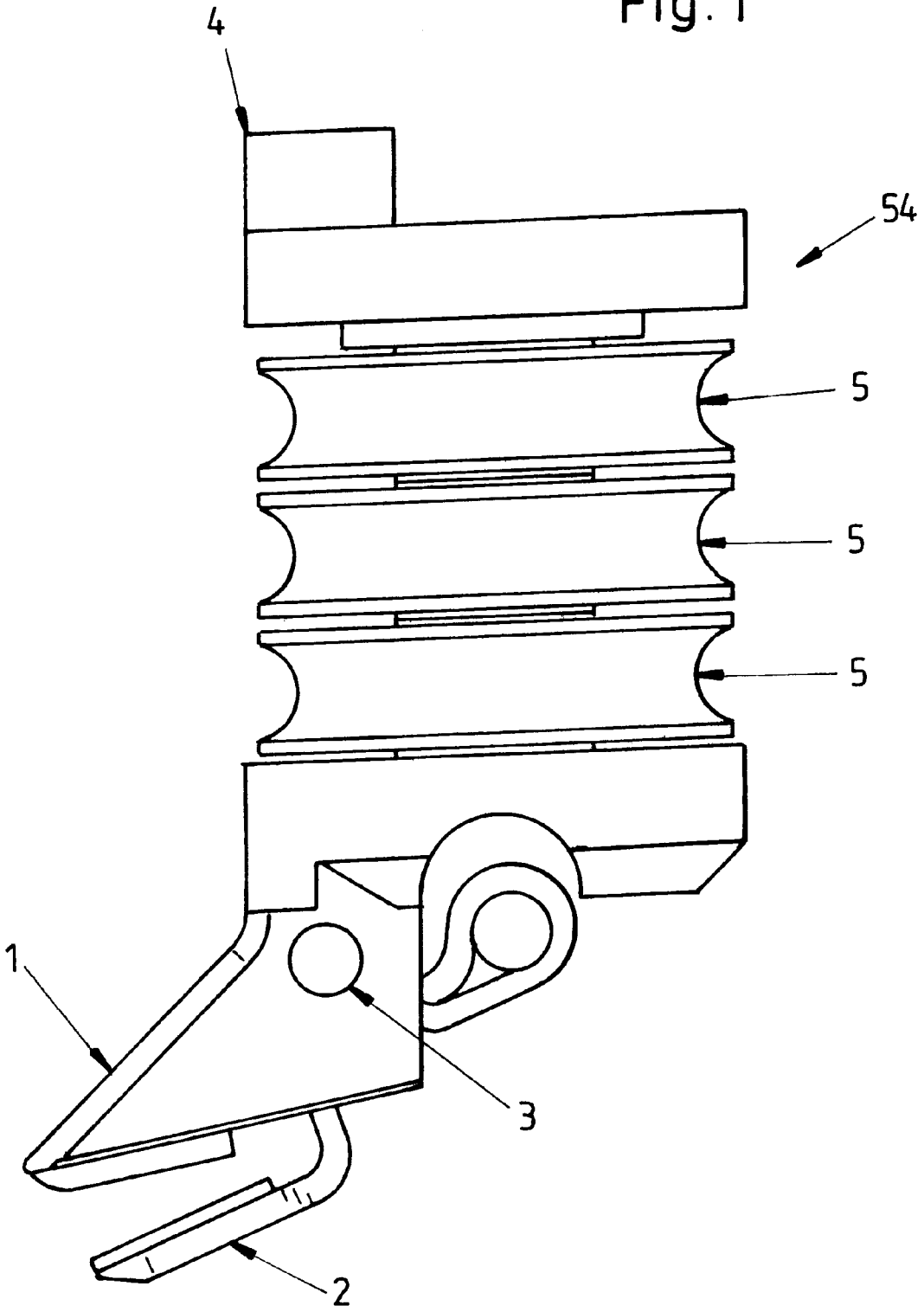
FIG. 1 is a side view of a power and free gripper module of the present invention.

FIG. 1 is a side view of a power and free gripper module 54, which acts as a gripper or holding element, used in the present invention. The power and free gripper module 54 includes an upper fixed jaw 1 and a lower movable jaw 2. In FIG. 1, lower jaw 2 is shown in an open position. Lower jaw 2 is movable from an open position to a closed position by rotation about a pivot pin 3. Gripper module 54 also includes guide rollers 5, which rotate independently from one another. A rotation control bushing 4 is used to rotate the gripper module 54 to a desired angular orientation.

Figure 2:
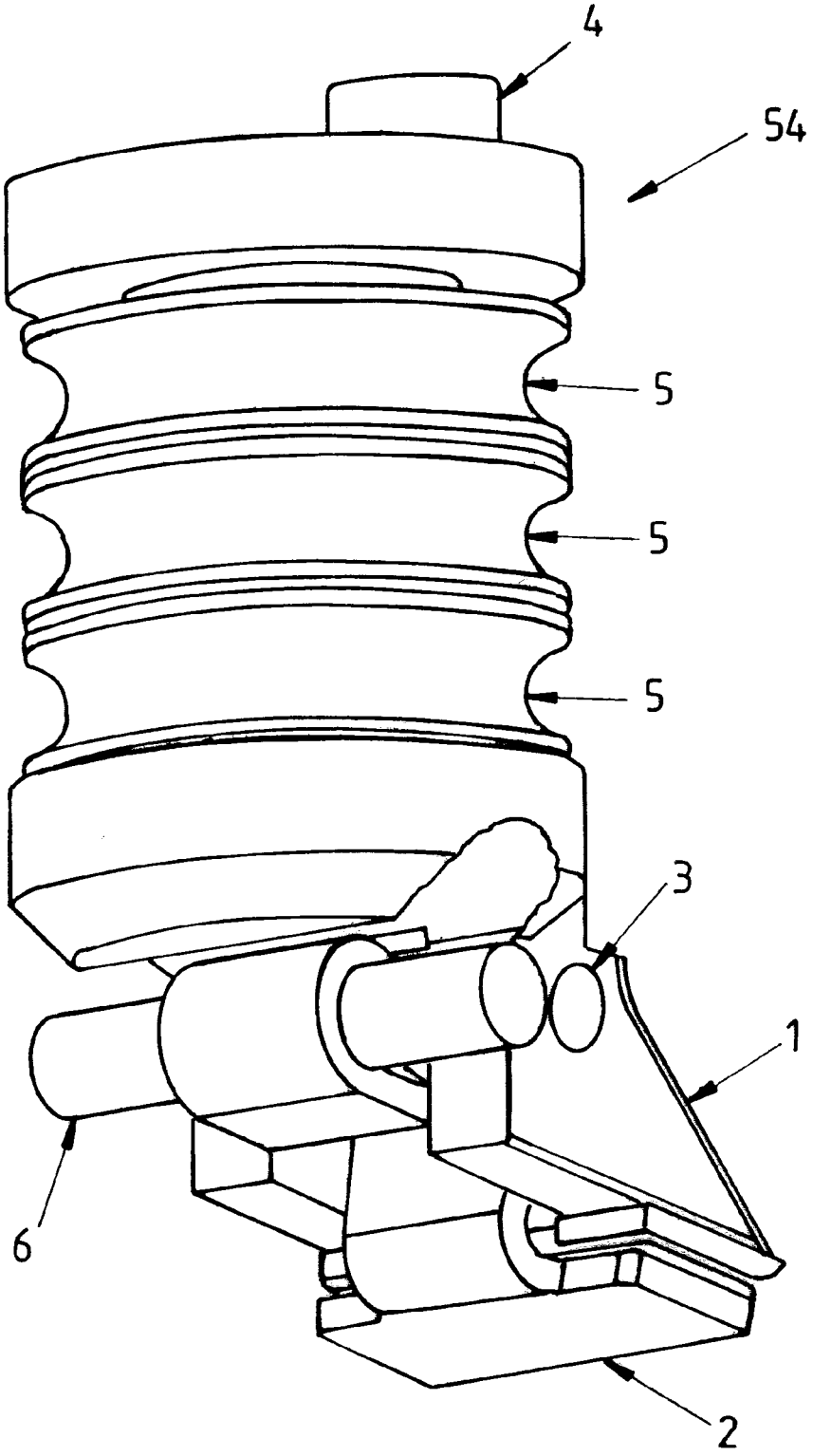
FIG. 2 is an isometric view of the gripper module of FIG. 1.

FIG. 2 is an isometric view of the rear of gripper module 54. In FIG. 2, the lower jaw 2 is in a closed position. FIG. 2 shows a gripper opening pin 6 for gripper module 54, which gripper opening pin 6 is connected to lower jaw 2 and rotates about pivot pin 3. Upward rotation of gripper opening pin 6 rotates the lower jaw 2 downward about pivot pin 3, thereby moving lower jaw 2 to the open position. Downward rotation of gripper opening pin 6 rotates the lower jaw 2 upward about pivot pin 3, thereby moving lower jaw 2 to the closed position.

Figure 3:
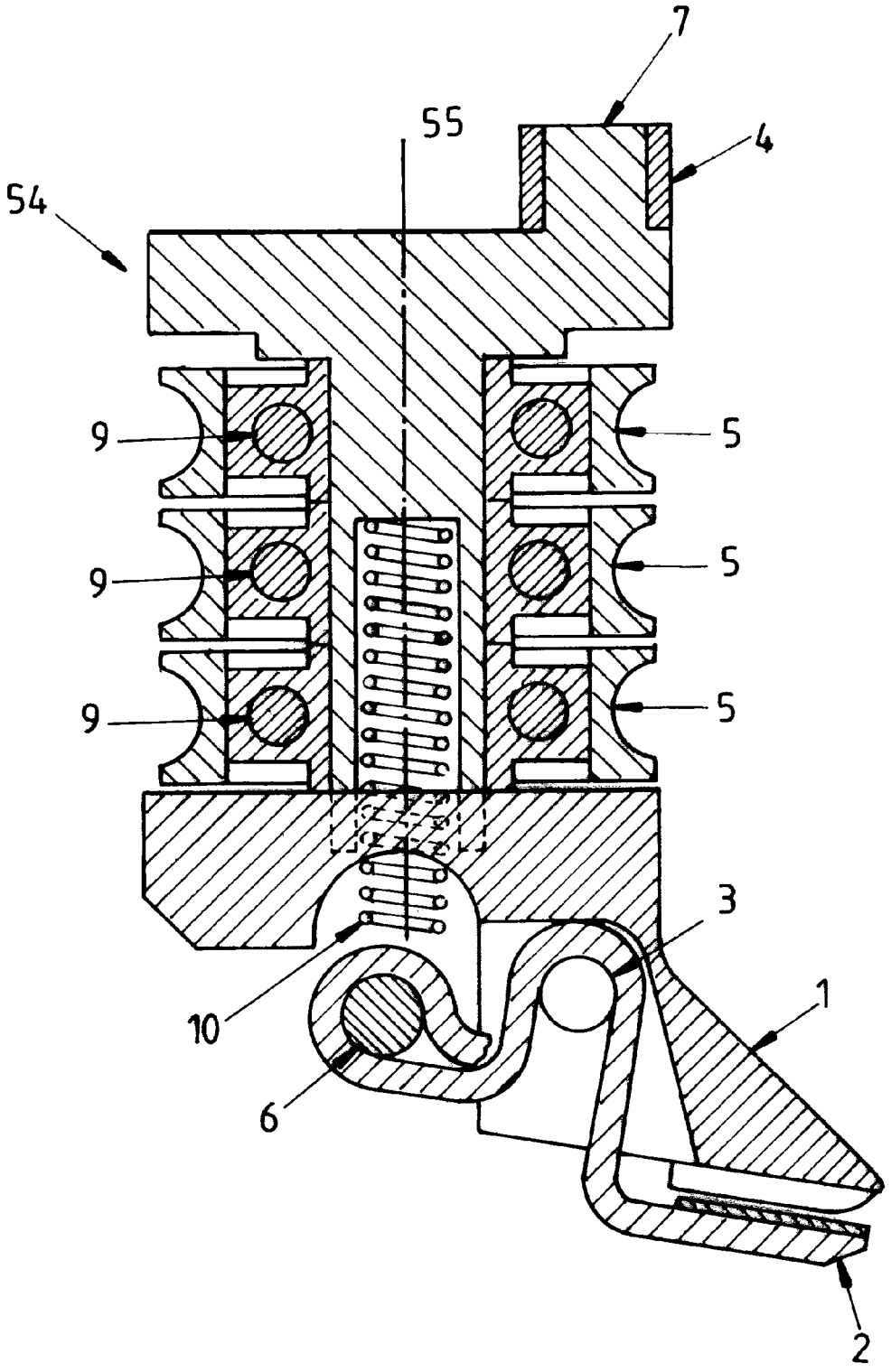
FIG. 3 is a cross-sectional view of the gripper module of FIG. 1.

FIG. 3 is a cross-sectional view of the gripper module 54. A coil compression spring 10 pushes on the end of lower jaw 2 surrounding opening pin 6, thereby biasing lower jaw 2 to a closed position, as shown in FIG. 3. A biasing force therefore retains a signature in gripper module 54 between upper jaw 1 and lower jaw 2. Each of the guide rollers 5 is mounted on a bearing 9 (shown schematically in FIG. 3), to allow the guide rollers 5 to each individually freely rotate about guide module centerline 55. Rotation control bushing 4 rotates freely about a boss 7 on the top of the gripper module 54.

Figure 4:
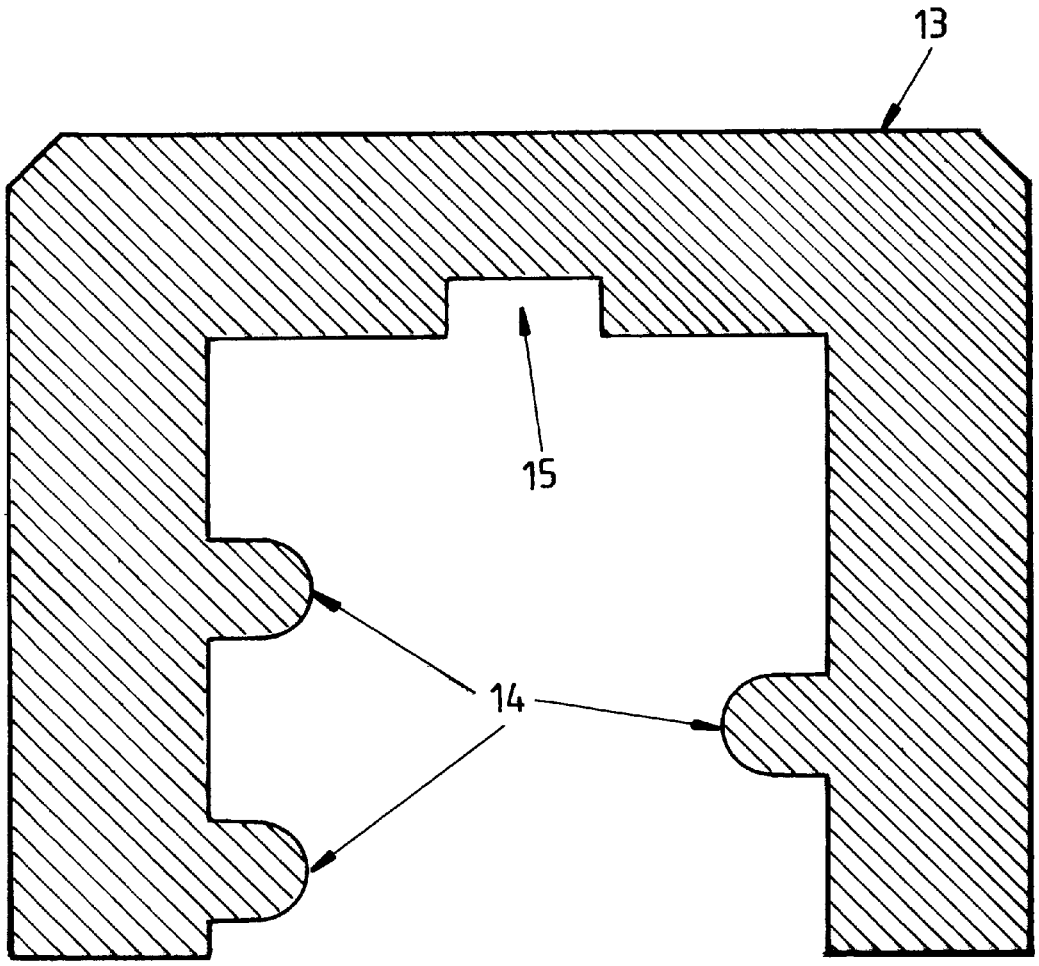
FIG. 4 is a cross-sectional view of a track in which the gripper module rides.
Figure 5:
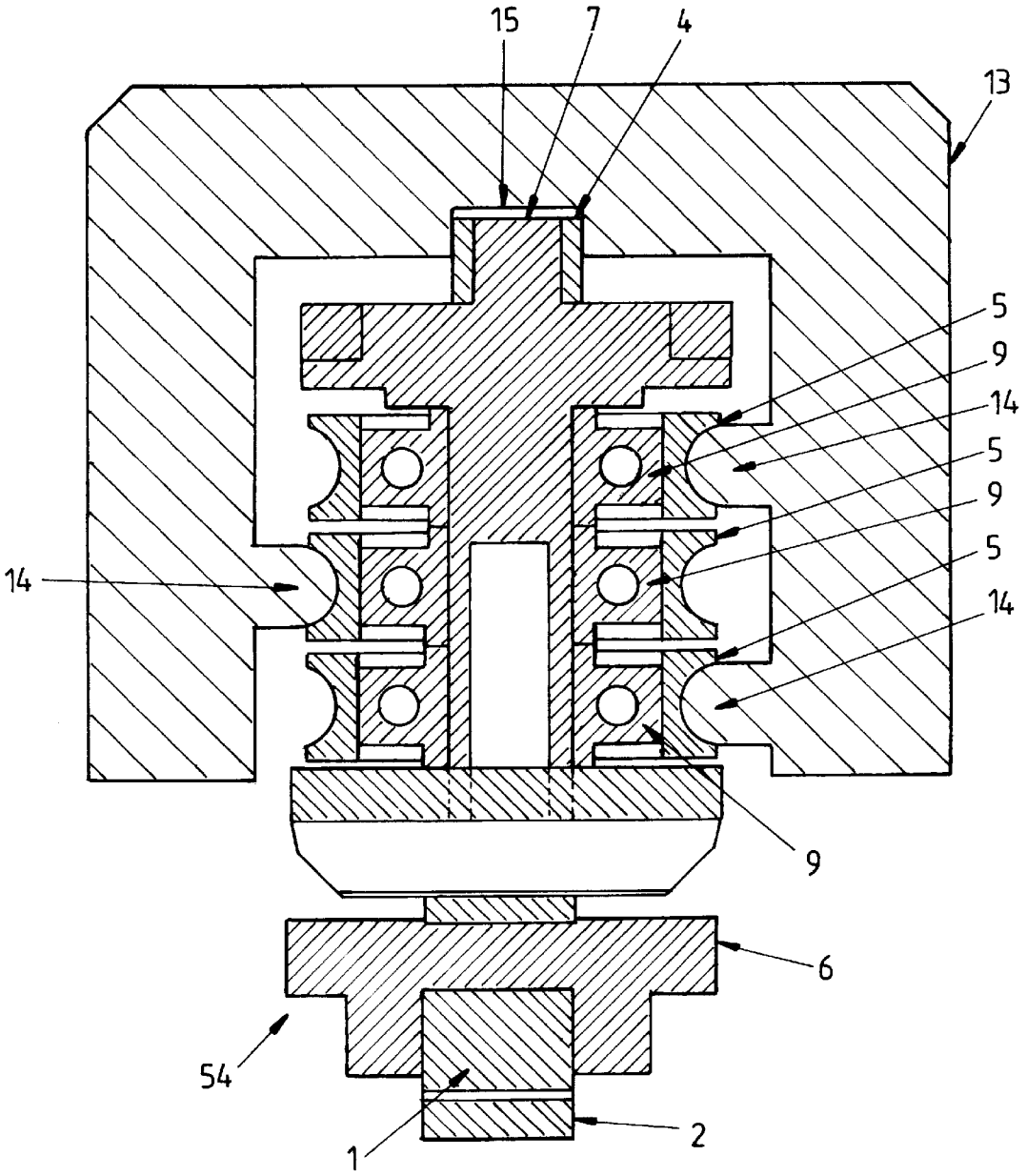
FIG. 5 is a cross-sectional view of a gripper module mounted in the track of FIG. 4.
Figure 6:
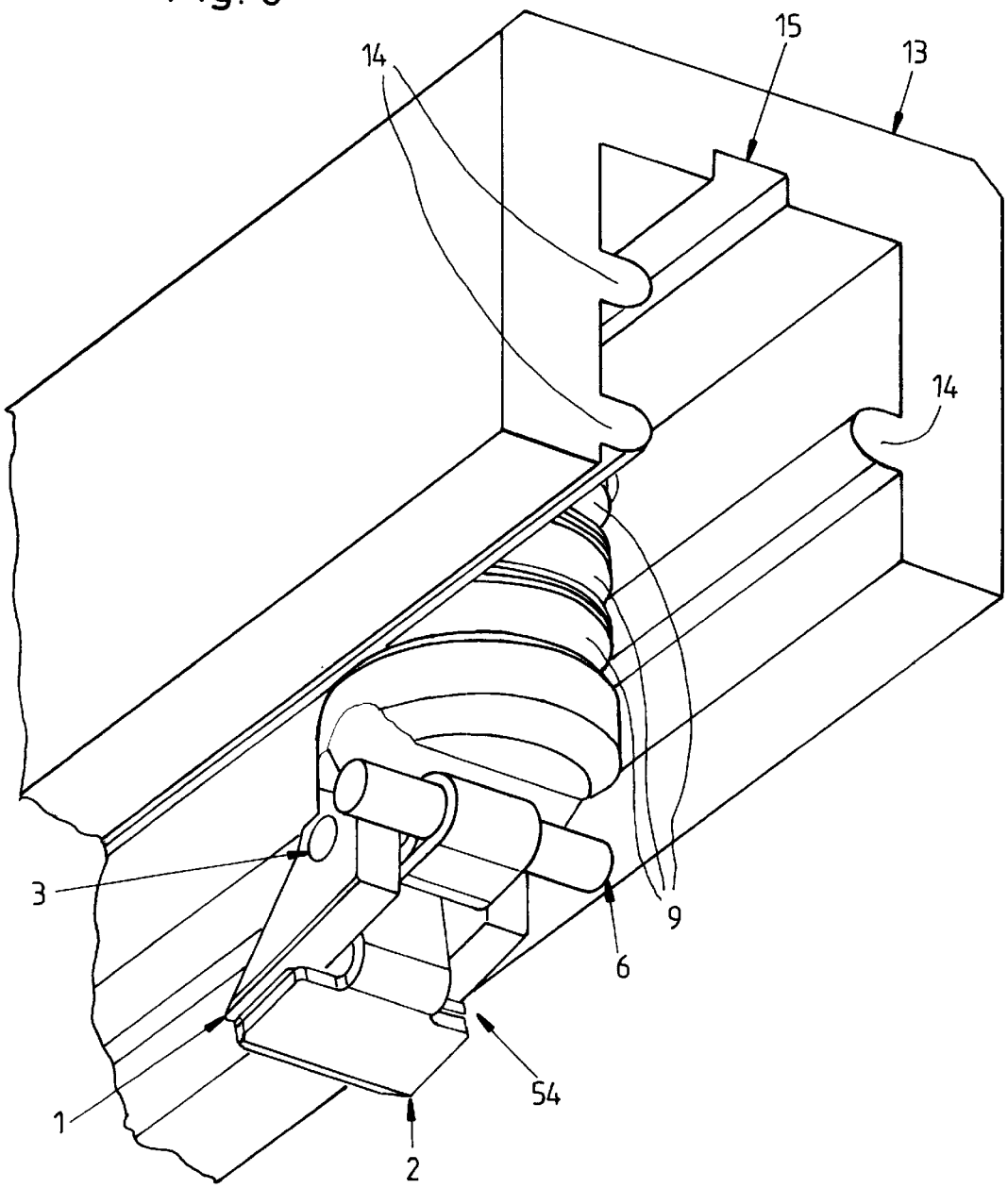
FIG. 6 is an isometric view of a gripper module riding in a track.

FIG. 4 is a cross-sectional view of a track 13 in which the gripper modules 54 ride. The track 13 includes raised sections 14 on the inside which ride in the grooves in the guide rollers 5, to thereby constrain the gripper modules 54 within the track 13. A slot 15 in the track 13 controls the angular orientation of the gripper module 54, by controlling the position of the rotation control bushing 4, which rides in slot 15. As shown in FIGS. 5 and 6, in a preferred embodiment, the upper and lower raised sections 14 ride in the right side of the upper and lower guide rollers 5, and the middle raised section 14 rides in the left side of the middle guide roller 5. Thus, the gripper module 54 rides freely in the track 13, and may be driven along the track either by gravity or by any known apparatus for imparting momentum to a freely-moving apparatus along a track, e.g., driven sprockets or chains, etc., placed at locations spaced along the length of the track 13.

Figure 7:
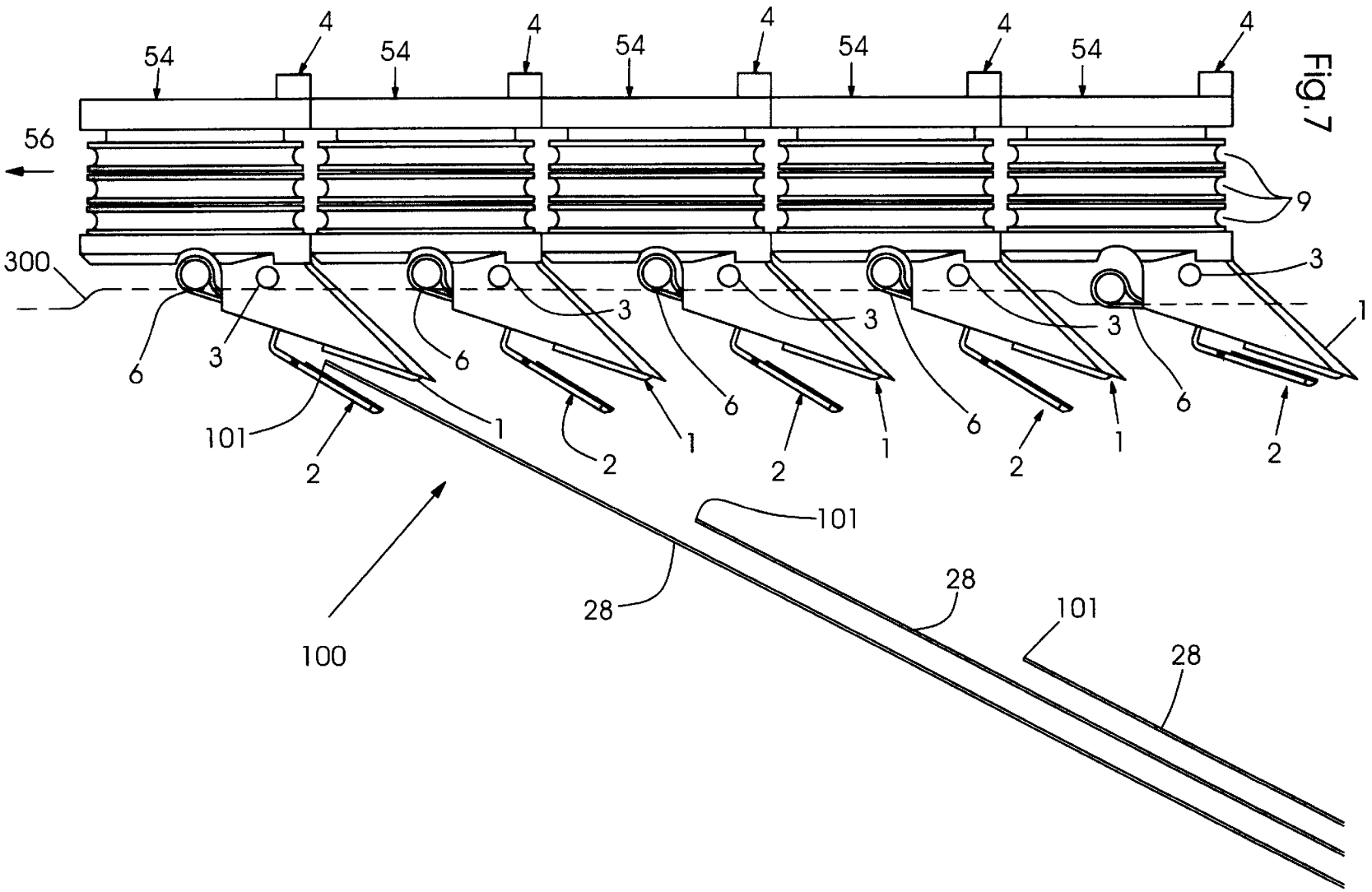
FIG. 7 is a side view of a series of gripper modules intercepting a series of signatures.

FIG. 7 shows a series of gripper modules 54 traveling in the direction 56. In FIG. 7, track 13 is omitted for clarity, but it is to be understood that the modules 54 in FIG. 7 all ride along a track 13. A series of signatures, e.g., sheets, 28 are conveyed in a direction such that they intercept the path of the gripper modules 54 at an intersection point 100. Prior to reaching the intersection point 100, the gripper modules 54 have their lower jaws 2 in contact with the upper jaw 1, thereby placing the gripper module in the closed position (see uppermost gripper module 54, FIG. 7). As the gripper modules approach the intersection point 100, the gripper opening pin 6 is pushed to the left by a gripper opening cam 300 (shown in dashed lines in FIG. 7). The lower jaw 2 is therefore held open until a leading edge 101 of the signature enters the space between the lower 2 and upper 1 jaw of a gripper module 54 (see lowermost gripper module 54, FIG. 7). After the leading edge 101 of a signature 28 enters between the lower 2 and upper 1 jaws, the gripper opening pin 6 passes the gripper opening cam 300 and the lower jaw 2 closes against the upper jaw 1, as a result of the biasing force of the spring 10, thereby holding the signature 28 in the gripper module 54.

Figure 8:
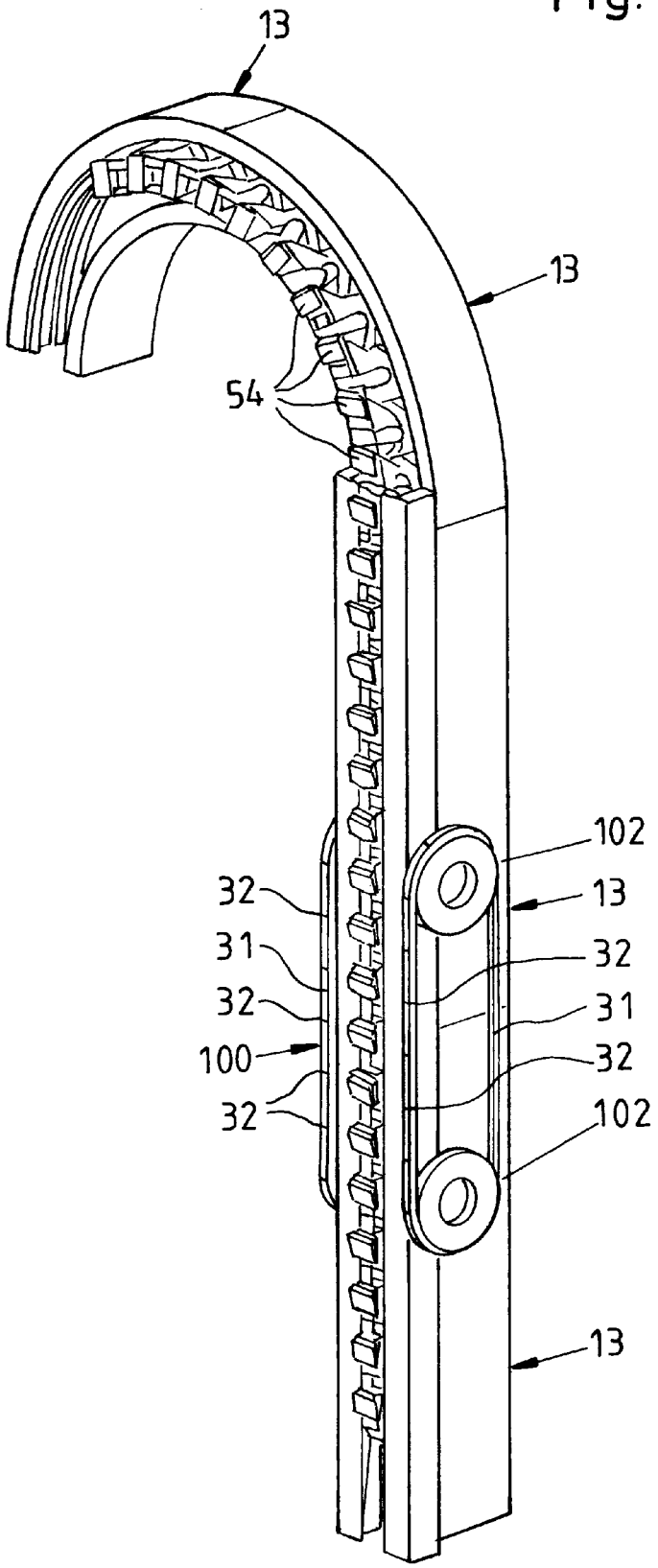
FIG. 8 is an isometric view of a series of grippers traveling in a track past an intersection point.

FIG. 8 shows gripper modules 54 traveling along tracks 13 past the intersection point 100. The signatures 28 are not shown in FIG. 8 for clarity. A short section of chain 31 travels on both sides of the gripper modules 54 at the intersection point. The chains 31 are entrained around sprockets 102 and travel in the same direction and at the same speed as gripper modules 54. Registration pins 32 on the chains 31 are aligned with the gripper modules 54. The registration pins 32 support the leading edges 101 of the signatures 28 until the gripper modules 54 are closed on the signatures 28. The manner in which the leading edges 101 of the signatures 28 are fed into registration pins 32 and in between jaws 1, 2 is described below with reference to FIG. 9.

Figure 9:
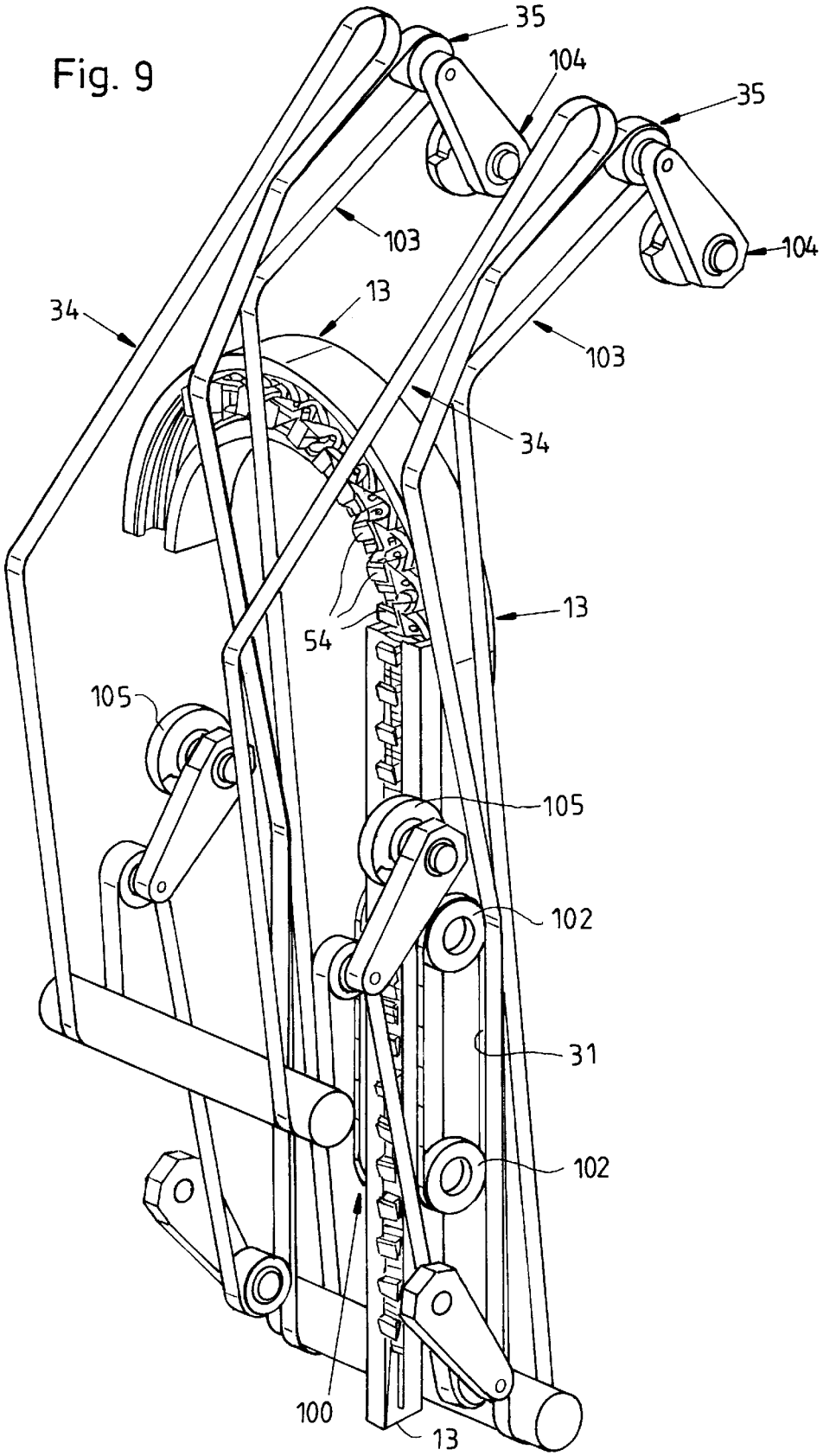
FIG. 9 is an isometric view of transport belts which transport signatures to the intersection point.

FIG. 9 shows transport belts 34, 103 which transport the signatures 28 to the intersection point 100. The signatures 28 enter between the belts 34, 103 at insert point 35, and are carried between the belts 34, 103 until they contact registration pins 32 and are thereafter fed into and are gripped by the gripper modules 54 at the intersection point 100. Motors 104 may drive transport belts 103, and motors 105 may drive transport belts 34.

Figure 10:
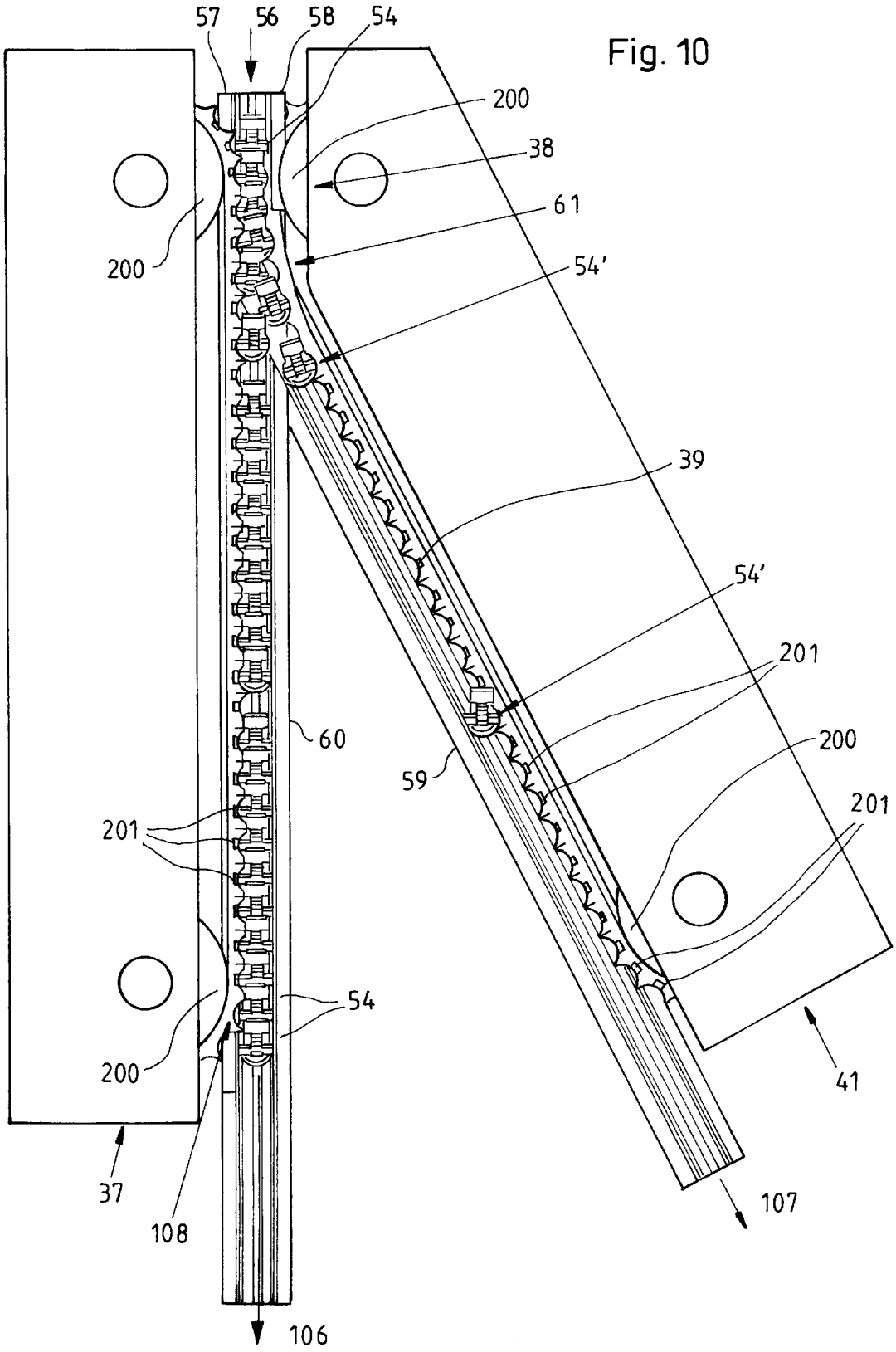
FIG. 10 is a bottom view of gripper modules traveling on alternate paths.

FIG. 10 shows the manner in which the gripper modules 54 may be diverted to alternate paths. In the circumstances when a gripper module 54 has received either a miss or a double (i.e., has gripped no signatures or more than one signature), that gripper module 54 will be directed along a diversion path 107. The gripper modules travel in a common area 38 along a path 56 until they reach a diversion location 61. The left 37 and right 41 sides of the track 57, 58 constrain the gripper modules 54 on either side in the common area 38. At the diversion location 61, the right track 58 diverges from the straight path of the left track 57. After the right track 58 has diverged a sufficient distance from the left track 57, new track sides 60, 59 are introduced. Track side 59 becomes the left side of the diversion path 107 and track side 60 becomes the right side of the primary path 106. Because of the diversion of the tracks 57, 58 at the diversion location 61 the gripper modules 54 are not constrained by the track sides 57, 58 alone. Gripper modules 54 that are to be diverted along the diversion path 107 are held along track side 58 by a drive element 39 until they are restrained by both track side 58 and track side 59. Similarly, gripper modules 54 that are to be diverted along the primary path 106 are held along track side 57 by a drive element 108 until they are restrained by both track side 57 and track side 60.

The drive elements 39, 108 are preferably constructed in the form of a belt or chain entrained and driven around sprockets or pulleys 200. Each segment of the drive elements 39, 108 which mate with one side of one gripper module 54 includes a releasable gripping element 201 (shown schematically in FIG. 10), one gripping element 201 for each side of each gripping module 54. Releasable gripping elements 201 can be in the form of electromagnets, or any known mechanical latch for engaging and holding one side of a gripping module 54 which is in contact with drive elements 39, 108. An upstream sensor (not shown) is used to sense each gripping module 54 and determine if that gripping module 54 has a single signature 28 or contains a miss or a double. In the former case, a releasable gripping element 201 on drive element 108 will be actuated to engage the gripping module 54, while the corresponding releasable gripping element 201 on drive element 39 will not be actuated. In the latter case, a releasable gripping element 201 on drive element 39 will be actuated to engage the gripping module 54, while the corresponding releasable gripping element 201 on drive element 108 will not be actuated. As a result, the gripping modules 54 are diverted by the releasable gripping elements 201 on one of the drive elements 39, 108, which will direct each gripping module 54 down either primary path 106 or down diversion path 107.

Figure 11:
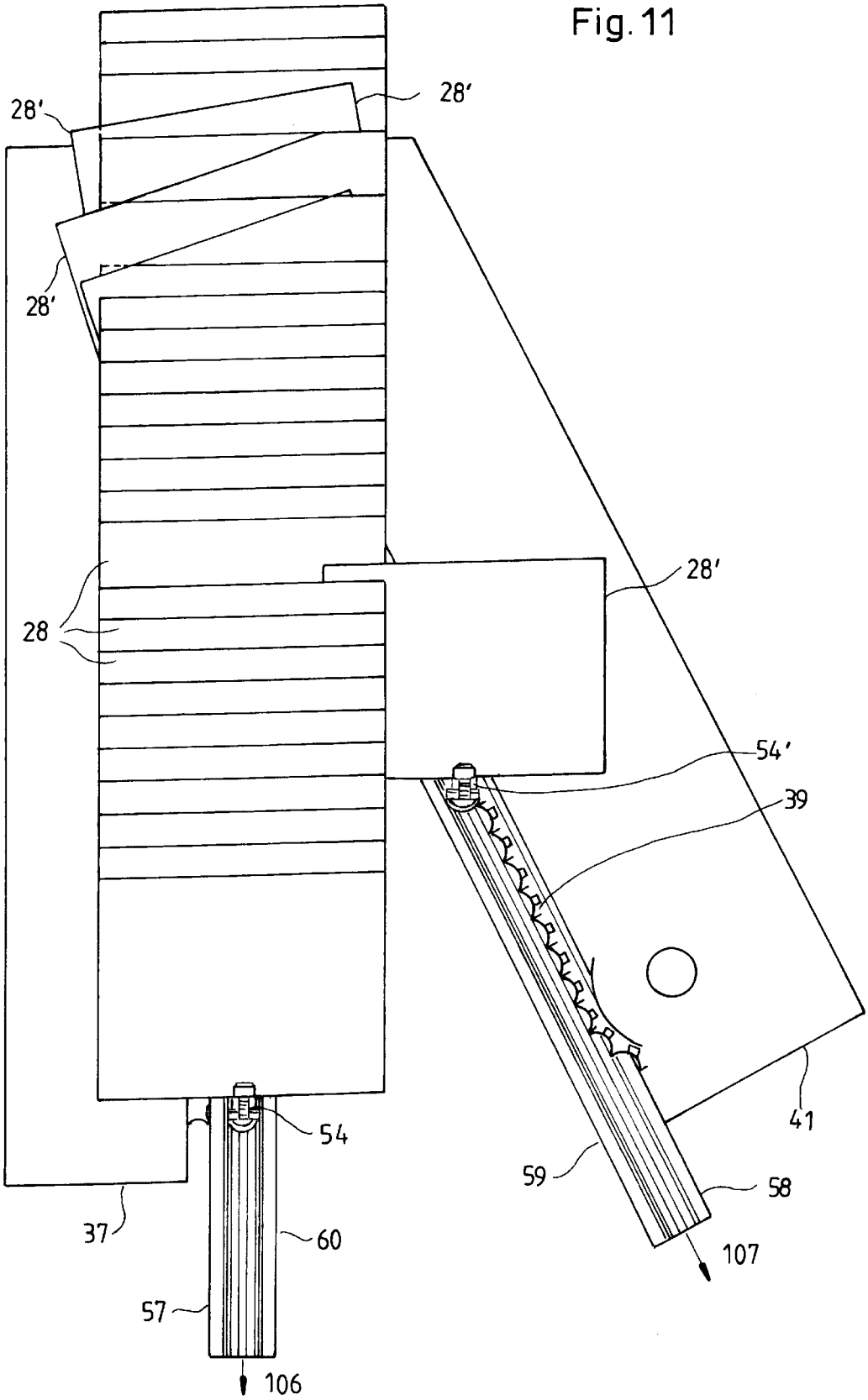
FIG. 11 is a bottom view of signatures carried in gripper modules traveling on alternate paths.

FIG. 11 shows a series of signatures 28 being conveyed along primary path 106 by a series of gripper modules 54. FIG. 11 also shows individual signatures 28' being diverted along diversion path 107 by gripper modules 54'. As shown in FIG. 11, the signatures 28' being diverted on diversion path 107 are doubles, it being understood that in the case of misses, an empty gripper module 54' without a signature 28 would be diverted along diversion path 107. Along primary path 106 there will initially be gaps in the queue which correspond to the diversion of gripper modules 54' down the diversion path 107. These gaps in the queue are eliminated downstream of the drive element 39, after the gripper modules 54 are released and allowed to freely move along track 13. This free movement allows re-queuing of the gripper modules 54, which move to positions directly adjacent one another (see FIG. 14), thereby ensuring a complete queue of singularized signatures to be fed to the collator.

Figure 12:
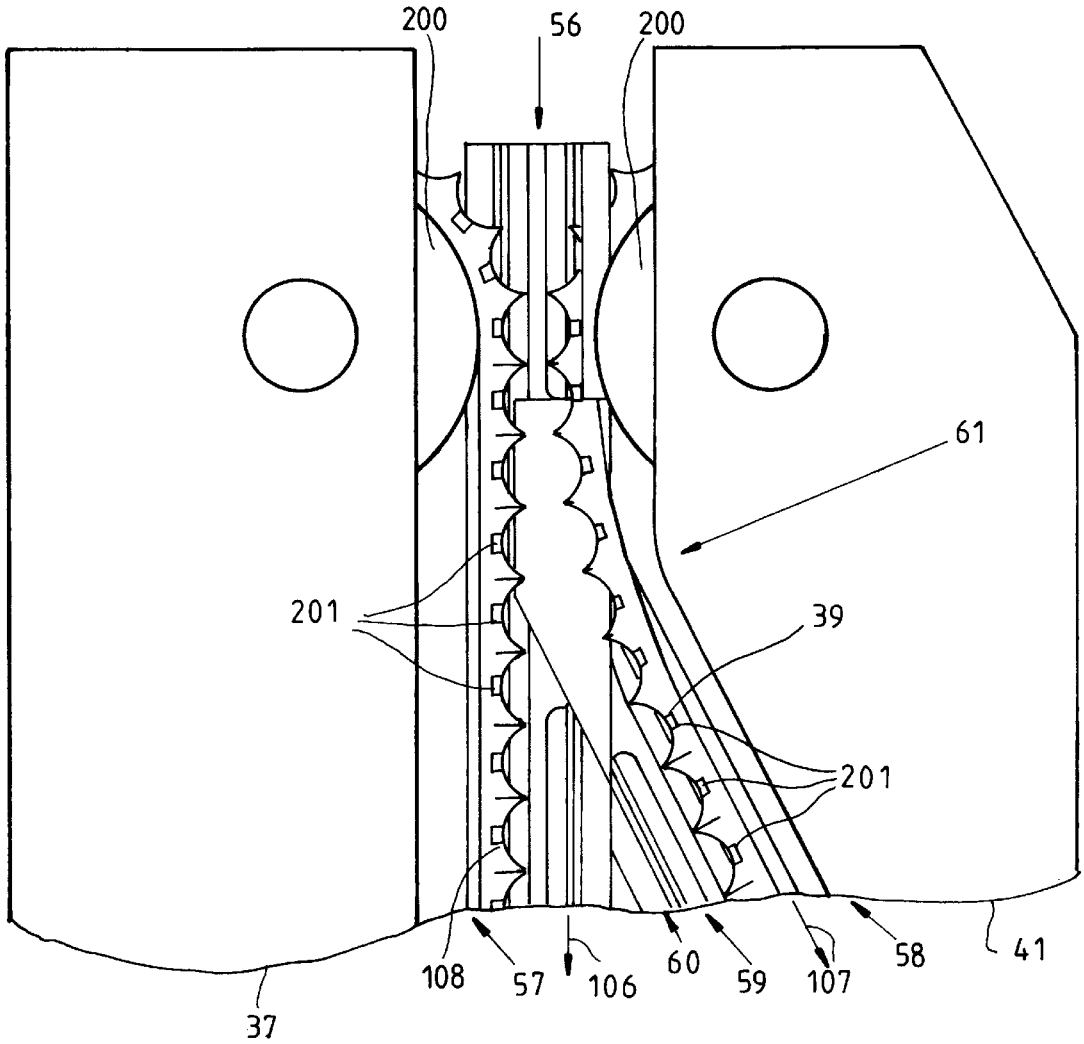
FIG. 12 is a detail bottom view of a divert for the gripper modules.
Figure 13:
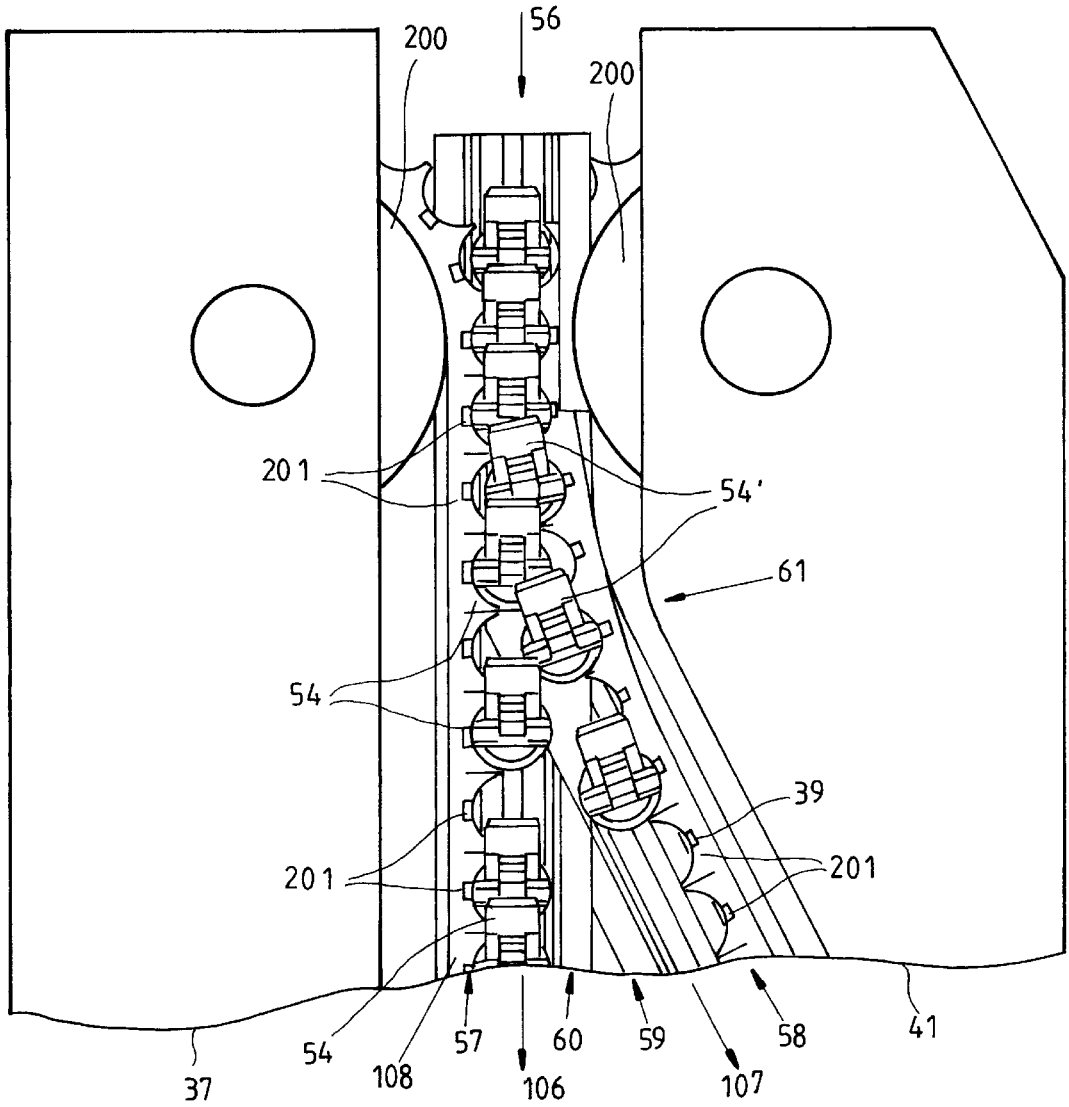
FIG. 13 is a detail bottom view of gripper modules being diverted.

FIG. 12 shows a detail view of the diversion location 61 without gripper modules 54, and FIG. 13 shows a detail view of the diversion location with the gripper modules 54 being conveyed along primary path 106 and gripper modules 54' being diverted along diversion path 107.

Figure 14:
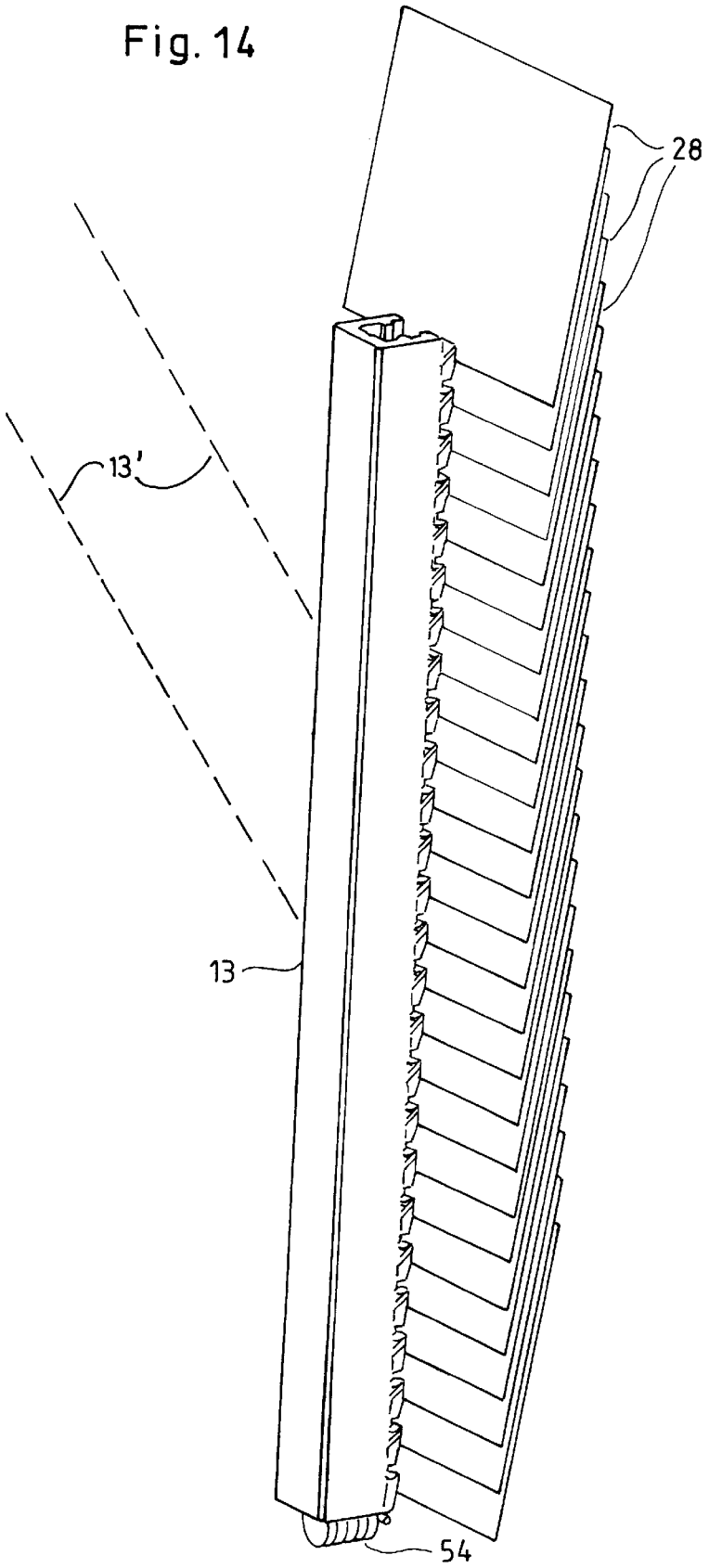
FIG. 14 is an isometric view of a signature queue.

FIG. 14 shows a queue of signatures 28 which have passed through diversion location 61 and along primary path 106, and which have been re-queued as a result of the free movement of the gripper modules 54 in track 13. As can be seen in FIG. 14, the signature queue contains a series of signatures 28, all of which do not contain a signature fault, all of which are in a queue without gaps, and all of which may be sequentially fed into a collation apparatus to thereby produce a complete bundle. The gripper modules 54 holding the signatures 28 are guided along a straight section of track 13 which acts as a queuing track.

It is to be understood that a collation apparatus utilizing the method and apparatus of the present invention will contain a number of the track and gripper systems described above, one for each signature to be inserted into a bundle for collation. Although described above as a single track system for each signature to be inserted in a bundle, other configurations are possible, in particular to assist in the clearing of jams. For example, the apparatus of the present invention may be configured to continue to accept signatures into the queue as the feed jam is cleared. In such a configuration, the gripper conveyor system can allow signatures to be entered into the queue at a rate faster than the rate at which the collation machine removes signatures from the queue, either upon detection of a jam, or upon clearing of a jam by the operator. Once the jam is cleared, the singularization process replenishes the queue at a faster rate than signatures are removed from the queue, to allow the queue to "catch up" to the jam and the disruption in the queue caused by the jam and the operator's actions in clearing the jam. This feature enables a buffer of grippers in the signature queue, which buffer replenishes the queue while jams are being removed or after the jams are removed. As a result, the jam may be cleared during the process of feeding signatures to a collator from the queue, without the need to stop the collation process to clear the jam. A second technique for dealing with jams is to provide multiple singularization stations which feed the same singularization queue—i.e., a plurality of feed tracks 13 of gripper modules 54 which all feed into a single queuing track 13 to the collator. A gate or diverter at the point where the multiple tracks 13 meet the single track 13 controls the apparatus such that the single track 13 is only fed from one of the multiple tracks feeding into the single track 13. This technique allows a redundant feed track to be activated and to feed the signature queue if the primary feed track jams and must be stopped to allow clearing.

In the above description of the invention, those skilled in the art will perceive improvements, changes and modifications. For example, the present invention could be used to transport any type of article to a location using any number of different holding elements, and is not limited to the transporting and collating of signatures. Improvements, changes and modifications within the skill of the art are intended to be covered by the appended claims.

What is claimed is:

1. An apparatus for feeding signatures into a collation device, the apparatus comprising:

at least one track, the at least one track comprising a diverter section, the diverter section comprising a primary path and a diversion path, wherein the at least one track includes at least one slot;

a plurality of grippers, the grippers being mounted in the at least one track for free movement in at least a portion of the primary path, wherein each gripper includes at least one bearing, the at least one bearing allowing rotational movement, and wherein each gripper includes at least one rotation control element, the at least one rotation control element of each gripper engaging the at least one slot of the at least one track, to thereby control a rotational orientation of each gripper in the bearing; and at least one drive element, the at least one drive element driving each of the grippers along either the primary path or the diversion path.

2. The apparatus of claim 1, wherein:

each gripper includes at least one bearing, the at least one bearing allowing free movement of the gripper in the at least one track.

3. The apparatus of claim 1, wherein:

each gripper includes at least one guide roller, and wherein the at least one track includes at least one raised section, the at least one guide roller of each gripper engaging the at least one raised section of the at least one track.

4. The apparatus of claim 1, further comprising:

an intersection point on the at least one track, the intersection point including a plurality of registration pins, the registration pins supporting an end of a signature as it is fed into one of the grippers.

5. The apparatus of claim 1, further comprising:

a queuing track located downstream of the primary path, the grippers freely moving in the queuing track.

6. The apparatus of claim 1, further comprising:

a plurality of tracks, the grippers being mounted in one of the plurality of tracks for free movement in at least a portion of the one of the plurality of tracks.

7. The apparatus of claim 1, wherein:

the grippers feed signatures to the collation device.

8. The apparatus of claim 1, further comprising:

at least one queuing track and a plurality of feeding tracks, each of the plurality of feeding tracks being joined to the at least one queuing track, to thereby feed grippers from the feeding tracks to the queuing track.

9. The apparatus of claim 1, further comprising:

at least one transport belt, the at least one transport belt transporting signatures into the grippers.

10. The apparatus of claim 9, wherein:

the at least one transport belt includes two transport belts, a signature being transported between the two transport belts.

11. The apparatus of claim 1, wherein:

the at least one drive element includes a primary path drive element for driving grippers along the primary path and a diversion path drive element for driving grippers along the diversion path.

12. The apparatus of claim 11, wherein:

the primary path drive element and the diversion path drive element include belts or chains.

13. The apparatus of claim 11, wherein:

the primary path drive element and the diversion path drive element include releasable gripping elements.

14. The apparatus of claim 13, wherein:

the releasable gripping elements include electromagnets.

15. The apparatus of claim 1, wherein:

each gripper includes two jaws, and wherein at least one of the jaws is movable relative to another jaw.

16. The apparatus of claim 15, further comprising:

a gripper opening cam, the at least one movable jaw contacting the gripper opening cam, the gripper opening cam moving the at least one movable jaw relative to the another jaw.

17. The apparatus of claim 15, wherein:

the at least one movable jaw is biased toward the another jaw.

18. The apparatus of claim 17, further comprising:

a spring, the spring biasing the at least one movable jaw.

19. An apparatus for conveying articles to a location, the apparatus comprising:

at least one track, the at least one track including a diverter section, the diverter section including a primary path and a diversion path, wherein the at least one track includes at least one slot;

a plurality of holding elements, the holding elements being mounted in the at least one track for free movement in at least a portion of the primary path, wherein each holding element includes at least one bearing, the at least one bearing allowing rotational movement, and wherein each holding element includes at least one rotation control element, the at least one rotation control element of each holding element engaging the at least one slot of the at least one track, to thereby control a rotational orientation of each holding element in the bearing; and at least one drive element, the at least one drive element driving each of the holding elements along either the primary path or the diversion path.

20. The apparatus of claim 19, wherein:

each holding element includes at least one bearing, the at least one bearing allowing free movement of the holding element in the at least one track.

21. The apparatus of claim 19, wherein:

each holding element includes at least one guide roller, and wherein the at least one track includes at least one raised section, the at least one guide roller of each holding element engaging the at least one raised section of the at least one track.

22. The apparatus of claim 19, further comprising:

a queuing track located downstream of the primary path, the holding elements freely moving in the queuing track.

23. The apparatus of claim 19, further comprising:

a plurality of tracks, the holding elements being mounted in one of the plurality of tracks for free movement in at least a portion of the one of the plurality of tracks.

24. The apparatus of claim 19, further comprising:

at least one queuing track and a plurality of feeding tracks, each of the plurality of feeding tracks being joined to the at least one queuing track, to thereby feed holding elements from the feeding tracks to the queuing track.

25. The apparatus of claim 17, wherein:

the at least one drive element includes a primary path drive element for driving holding elements along the primary path and a diversion path drive element for driving holding elements along the diversion path.

26. The apparatus of claim 25, wherein:

the primary path drive element and the diversion path drive element include belts or chains.

27. The apparatus of claim 25, wherein:

the primary path drive element and the diversion path drive element include releasable gripping elements.

28. The apparatus of claim 21, wherein:

the releasable gripping elements include electromagnets.

29. The apparatus of claim 19, wherein:

each holding element comprises two jaws, and wherein at least one of the jaws is movable relative to another jaw.

30. The apparatus of claim 29, further comprising:

a holding element opening cam, the at least one movable jaw contacting the holding element opening cam, the holding element opening cam moving the at least one movable jaw relative to the another jaw.

31. The apparatus of claim 19, wherein:

the at least one movable jaw is biased toward the another jaw.

32. The apparatus of claim 31, further comprising:

a spring, the spring biasing the at least one movable jaw.

33. A method for feeding signatures into a collation device, the method comprising:

providing at least one track comprising a diverter section, the diverter section including a primary path and a diversion path;

providing a plurality of grippers mounted in the at least one track for free movement in at least a portion of the at least one track;

feeding signatures into the plurality of grippers;

gripping signatures in at least some of the plurality of grippers;

controlling a rotational position of each gripper;

diverting grippers holding a single signature along the primary path; and diverting grippers not holding a single signature along the diversion path.

34. The method of claim 33, wherein:

the gripping includes gripping signatures between jaws movable relative to one another.

35. The method of claim 33, further comprising:

supporting ends of the signatures as they are fed into the grippers.

36. The method of claim 33, further comprising:

conveying grippers to a queuing track downstream of the primary path, wherein the grippers freely move in the queuing track.

37. The method of claim 33, further comprising:

providing a plurality of tracks and mounting the grippers in one of the plurality of tracks for free movement in at least a portion of the one of the plurality of tracks.

38. The method of claim 33, further comprising:

feeding signatures to the collation device.

39. The method of claim 33, further comprising:

providing at least one queuing track and a plurality of feeding tracks;

joining each of the plurality of feeding tracks to the at least one queuing track; and feeding grippers from the feeding tracks to the queuing track.

40. The method of claim 33, further comprising:

transporting signatures to the grippers.

41. The method of claim 40, wherein:

the transporting includes transporting the signatures between two transport belts.

42. The method of claim 33, wherein:

the diverting of grippers along the primary path includes driving grippers using a primary path drive element; and wherein the diverting of grippers along the diversion path includes driving grippers using a diversion path drive element.

43. The method of claim 42, wherein:

the driving of grippers using a primary path drive element includes releasably gripping the grippers; and wherein the driving of grippers using a diversion path drive element includes releasably gripping the grippers.

44. The method of claim 43, wherein:

the releasably gripping of the grippers includes releasably gripping the grippers using electromagnets.

45. A method for feeding articles to a location, the method comprising:

providing at least one track including a diverter section, the diverter section including a primary path and a diversion path;

providing a plurality of holding elements mounted in the at least one track for free movement in at least a portion of the at least one track;

feeding articles into the plurality of holding elements;

holding articles with at least some of the plurality of holding elements;

controlling a rotational orientation of each holding element;

diverting holding elements holding articles along the primary path; and diverting holding elements not holding articles along the diversion path.

46. The method of claim 45, wherein:

the holding includes holding articles between jaws movable relative to one another.

47. The method of claim 45, further comprising:

supporting ends of the articles as they are fed into the holding elements.

48. The method of claim 45, further comprising:

transporting articles to the holding elements.

49. The method of claim 45, further comprising:

conveying holding elements to a queuing track downstream of the primary path, wherein the holding elements freely move in the queuing track.

50. The method of claim 45, further comprising:

providing a plurality of tracks and mounting the holding elements in one of the plurality of tracks for free movement in at least a portion of the one of the plurality of tracks.

51. The method of claim 45, further comprising:

providing at least one queuing track and a plurality of feeding tracks;

joining each of the plurality of feeding tracks to the at least one queuing track; and feeding holding elements from the feeding tracks to the queuing track.

52. The method of claim 45, wherein:

the diverting of holding elements along the primary path includes driving holding elements using a primary path drive element; and wherein the diverting of holding elements along the diversion path includes driving holding elements using a diversion path drive element.

53. The method of claim 52, wherein:

the driving of holding elements using a primary path drive element includes releasably gripping the holding elements; and wherein the driving of holding elements using a diversion path drive element includes releasably gripping the holding elements.

54. The method of claim 53, wherein:

the releasably gripping of the holding elements includes releasably gripping the holding elements using electromagnets.

* * * * *